United States Patent [19]

Stilwell

[11] Patent Number: 4,611,200

[45] Date of Patent: Sep. 9, 1986

[54] PORTABLE BATTERY POWERED SMOKE DETECTOR AND CLOCK

[76] Inventor: Fred W. Stilwell, H C 62, Box 50, Merrill, Oreg. 97633

[21] Appl. No.: 664,097

[22] Filed: Oct. 24, 1984

Related U.S. Application Data

[63] Continuation of Ser. No. 363,983, Apr. 5, 1982, abandoned.

[51] Int. Cl.[4] ..... G08B 17/10; G04B 47/06

[52] U.S. Cl. ..... 340/628; 248/214; 340/546; 340/629; 368/11

[58] Field of Search ..... 340/628, 546, 629, 654; 368/276, 277, 316, 10, 12, 278, 11; 248/214

[56] References Cited

U.S. PATENT DOCUMENTS

| | | | |
|---|---|---|---|
| 596,680 | 1/1898 | Howe | 116/106 |
| 1,042,159 | 10/1912 | Simmons | 368/277 |
| 1,369,427 | 2/1921 | Hartley | 368/244 |
| 1,521,600 | 1/1925 | Crowe | 368/253 |
| 1,871,898 | 8/1932 | Manheimer | 368/10 |
| 2,552,331 | 5/1951 | Lamb | 368/12 |
| 2,771,560 | 11/1956 | Creiman | 368/10 X |
| 2,780,050 | 2/1957 | Florman | 368/277 |
| 3,166,742 | 1/1965 | Sherwin | 340/760 |
| 3,555,532 | 10/1968 | White et al. | 340/630 |
| 3,720,937 | 3/1973 | Lang et al. | 340/546 |
| 3,745,551 | 7/1973 | Smith | 340/546 |
| 3,747,331 | 7/1973 | Nyberg | 368/11 |
| 3,757,511 | 9/1973 | Burgess et al. | 368/83 |
| 3,824,789 | 7/1974 | Müller et al. | 368/73 |
| 3,846,773 | 11/1974 | Lintelmann et al. | 340/630 |
| 3,855,784 | 12/1974 | Foellner | 368/67 |
| 3,878,539 | 4/1975 | Gooding | 340/546 |
| 4,178,592 | 12/1979 | McKee | 340/693 |
| 4,186,389 | 1/1980 | Flittie | 340/630 |
| 4,236,239 | 11/1980 | Imgrüth et al. | 368/276 |
| 4,258,359 | 3/1981 | McLamb | 340/628 |
| 4,310,908 | 1/1982 | Fuerneisen | 368/277 |
| 4,319,234 | 3/1982 | Rice | 340/628 |
| 4,321,591 | 3/1982 | Vieweg | 340/546 X |
| 4,365,237 | 12/1982 | Knight | 340/628 |
| 4,438,428 | 3/1984 | Ober et al. | 340/628 X |

FOREIGN PATENT DOCUMENTS

| | | | |
|---|---|---|---|
| 78146 | 2/1951 | Norway . | |
| 274489 | 6/1951 | Switzerland | 368/10 |

OTHER PUBLICATIONS

Motorola Semiconductor Products Inc. data sheet, FIG. 2; showing integrated circuit MC 14466 as a smoke detector (1980).

*Primary Examiner*—James L. Rowland
*Assistant Examiner*—Daniel Myer
*Attorney, Agent, or Firm*—Klarquist, Sparkman, Campbell, Leigh & Whinston

[57] ABSTRACT

A compact case houses a battery powered smoke detector, and an alarm clock is detachably mounted to the case. A mechanism is provided for releasably securing the case to the upper edge of a door, picture frame, or the like, so that the smoke detector is positioned close to the ceiling of a room where it more effectively detects fire. The detachable clock is removed and placed at a more convenient location apart from the smoke detector, for example, on a table in the room. A three-position switch is provided. In one position, the switch cuts off power to the smoke detector to prevent unwanted alarms. In another position, the switch causes an emergency light to turn on while the smoke detector is simultaneously deenergized. In the third position, the switch couples the light to the smoke detector circuit and engages this latter circuit such that the light automatically turns on when the smoke detector alarm sounds.

4 Claims, 7 Drawing Figures

FIG. 2
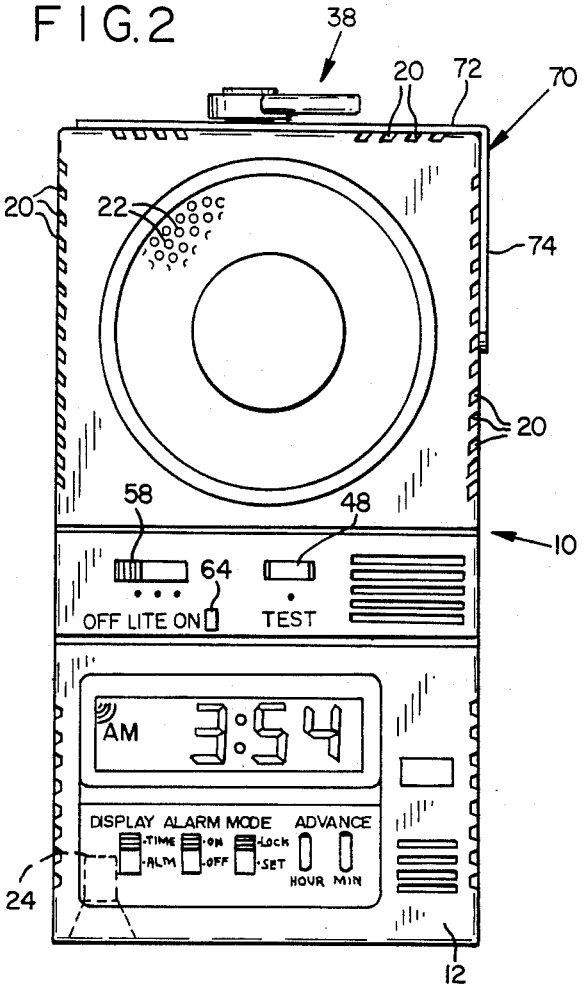
FIG. 3
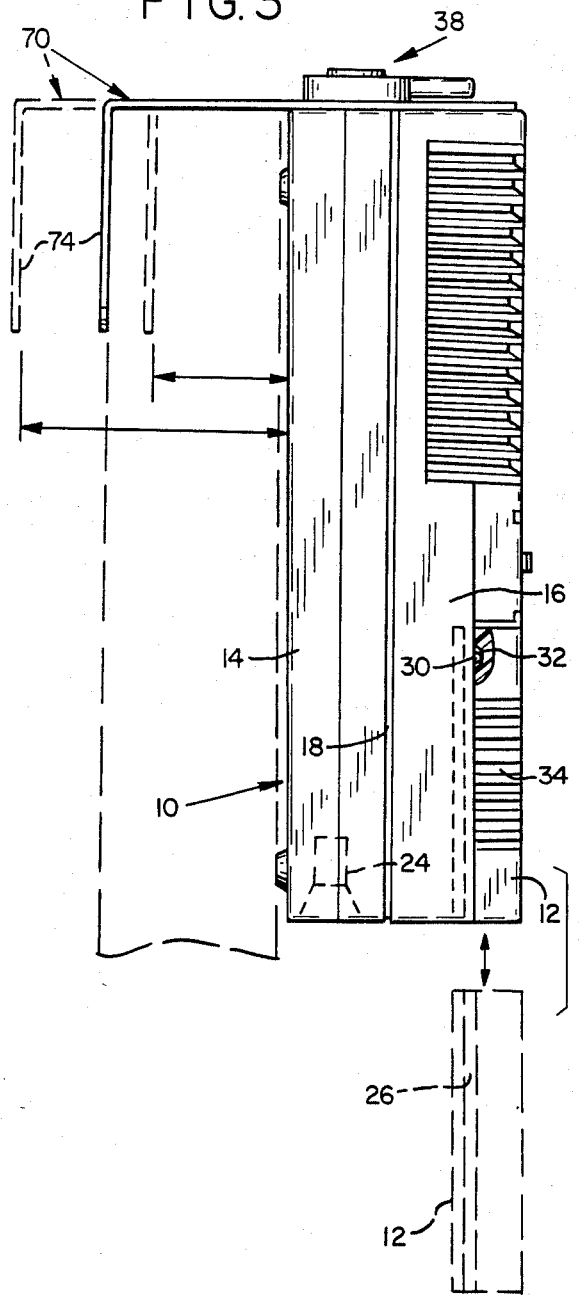
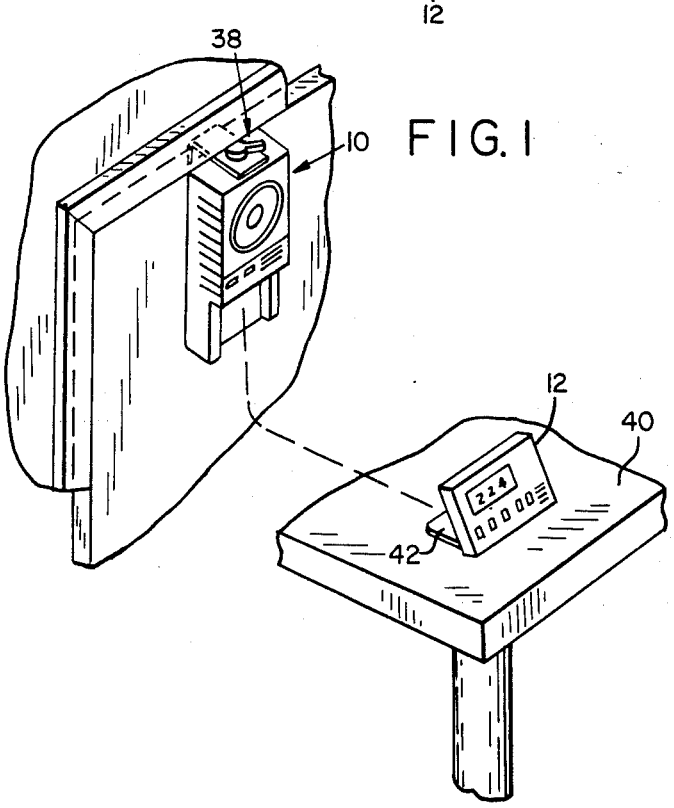
FIG. 1
FIG. 4
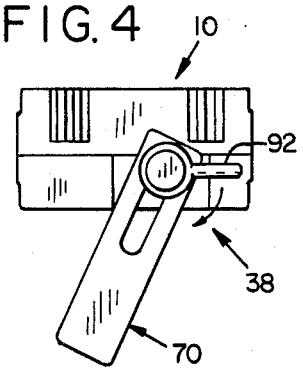

PORTABLE BATTERY POWERED SMOKE DETECTOR AND CLOCK

This application is a continuation of application Ser. No. 363,983, filed Apr. 5, 1982, now abandoned.

BACKGROUND OF THE INVENTION

The present invention relates to fire alarm devices, and, more specifically, to an improved portable battery powered smoke detector and clock which is particularly convenient for travelers.

During the past few years, numerous smoke detectors have appeared on the market. Typically, these devices are either powered by batteries or by house current, and are commonly of either the photoelectric or ionization detector type.

Although the use of protective smoke detector devices has expanded considerably, and in many instances building codes required their installation in new buildings, there are still many locations which lack such protection. For example, some hotels and motels either lack fire protection systems entirely, or do not have warning systems which are as fast acting as these smoke detector devices. For this reason, travelers in particular need an improved, compact, portable smoke detector that is convenient to carry with them and easy to use.

Also, it is known that products of combustion, such as heat and smoke from a fire, rise. Therefore, a portable smoke detector is needed which is easy to install high within a room.

Furthermore, travelers typically carry portable alarm clocks. Consequently, by integrating a smoke detector and an alarm clock within one unit, only one piece of equipment need be packed for a trip. This encourages travelers to carry the protective device with them.

It is therefore readily seen that individuals, including travelers, need additional protection against the dangers of smoke and fire in their accommodations.

SUMMARY OF THE INVENTION

The present invention comprises a portable battery powered smoke detector and alarm clock which is compact and easily carried. This makes the device extremely convenient and useful for travelers. The smoke detector is contained within a case and a mechanism is provided for releasably mounting the case to the upper edge of a door, picture frame, or the like. When so mounted, the smoke detector is positioned at a high elevation in the room for more effective fire detection. The alarm clock portion of the unit is detachably mounted to the case so that it can be removed and placed at a separate more convenient location. For example, on a stand at a traveler's bedside. A switch is provided for deactivating the smoke detector, and thereby preventing an alarm at inappropriate times, such as when the traveler is in transit from one location to another. The case also supports a light which, when the switch is in a second position, is on to provide emergency lighting. When the switch is in a third position, the light is electrically coupled to the smoke detector and turns on automatically in the event an alarm is sounded. This provides the traveler with light in the event of a fire.

It is accordingly a primary object of the invention to provide an improved portable smoke detector and alarm clock.

It is still another object of the invention to provide a portable smoke detector and alarm clock which is battery powered so as not to be dependent upon the power source of the building.

A further object of the invention is to provide a portable smoke detector and alarm clock which includes a mechanism for releasably mounting the smoke detector at an upper elevation within a room, and in which the alarm clock is detachable so that it may be placed at a more convenient location.

Still another object of the invention is to provide a portable smoke detector and alarm clock which is capable of providing emergency lighting automatically upon detection of a fire, and also selectively as desired by a traveler.

A further object of the invention is to provide a portable smoke detector and alarm clock in which the smoke detector is disabled during transit to prevent spurious alarm signals.

Another object of the invention is to provide a portable smoke detector and alarm clock which is reliable, compact, lightweight, and relatively easy to manufacture.

Other objects, as well as features and advantages of the present invention, will become more apparent from the following detailed description which proceeds with reference to the accompany drawings.

BRIEF DESCRIPTION OF THE DRAWINGS

In the drawings:

FIG. 1 is a perspective view of a portable battery powered smoke detector and alarm clock in accordance with the invention in which the clock is detached from the case and in which the case is mounted to the upper edge of a door;

FIG. 2 is a front elevational view of a portable smoke detector and alarm clock in accordance with the invention;

FIG. 3 is a side elevational view of a portable smoke detector and alarm clock in accordance with the invention, with the door mounting mechanism shown in various positions;

FIG. 4 is a top view of a portable smoke detector and alarm clock in accordance with the invention;

DETAILED DESCRIPTION OF THE PREFERRED EMBODIMENT

Figure 6:
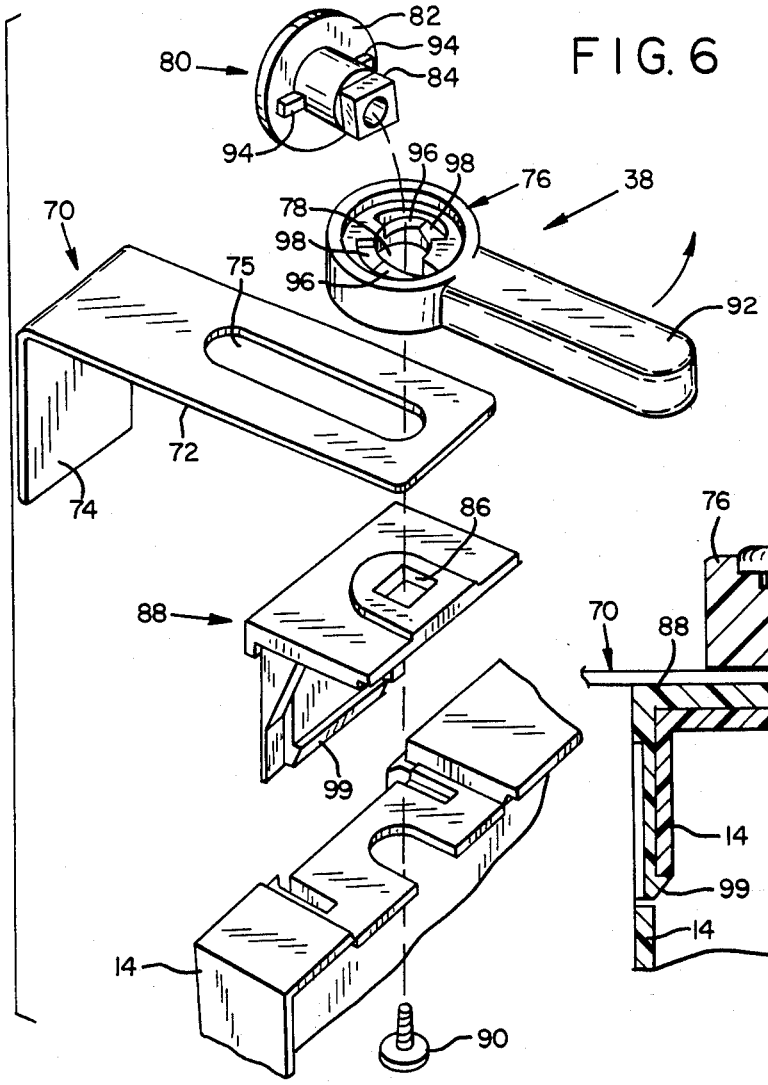
FIG. 6 is an exploded view of a door mounting mechanism in accordance with the invention.

With reference to FIGS. 1, 2 and 3, a portable battery powered smoke detector and alarm clock includes a hollow generally rectangular case 10 which contains a smoke detector, which may be of the ionization chamber type, and an alarm clock 12 detachably mounted to the case. The case is formed of a front section 16 and back section 14 which interfit along a joint 18 and are held together, as by screws (not shown). Slots 20 are provided through the upper side portions of case section 16 and also through the top of this case section. These slots provide access paths through which products of combustion from a fire reach the smoke detector contained within the case. Additional access openings 22 pass through the face of case section 16. Also, a lamp 24 is mounted to case section 14 to shine downwardly from the bottom of the case 10 at times and for purposes explained below.

The clock 12 has a rectangular body which is detachably mounted to case 10 so that it can be removed from the case as desired and placed at a more convenient location. The case section 16 defines a void, extending transversely across the case, into which the clock body is positioned when the clock and case are connected together. Specifically, grooves or channels 26 are formed in the side edges of the clock housing. Corresponding tongues are formed in case section 16 in a position to slidably fit within the grooves 26 as the clock is attached and detached from the case 10. Case section 16 also includes a detent 30 which fits within a detent opening 32 in the underside of the clock housing. This snaps the clock to the case and prevents the clock from separating from the case at undesired times, for example, during transit. Ridges 34 are provided at the sides of the clock housing to facilitate gripping of the clock housing and removal of the clock from the case 10.

In the preferred embodiment, the case 10 and clock housing are formed of a durable lightweight plastic. Also, with this construction, the device is extremely compact. The disclosed preferred embodiment is rectangular and is approximately 3 inches wide, $5\frac{1}{4}$ inches high, and $1\frac{1}{2}$ inches deep.

A mechanism 38, described in detail below, is provided for detachably securing the case to the upper edge of a door, picture frame, or equivalent object within a room. This positions the smoke detector at an upper elevation, that is near the ceiling, within the room. Therefore, because smoke, heat and other products of combustion rise, the smoke detector is positioned to more effectively detect the presence of a fire. Also, because the clock 12 is detachable from case 10, it can be removed, as shown in FIG. 1, and placed at a location within the room which is more convenient for the user. For example, it may be placed on a table 40 adjacent to the bed of a traveler. The clock 12 is provided with a hinged backplate 42 which folds down to support the clock in an upright position on the table. The back of the clock is recessed so that when the backplate 42 is folded against the clock, it does not interfere with the attachment and detachment of the clock to and from the case.

Figure 5:
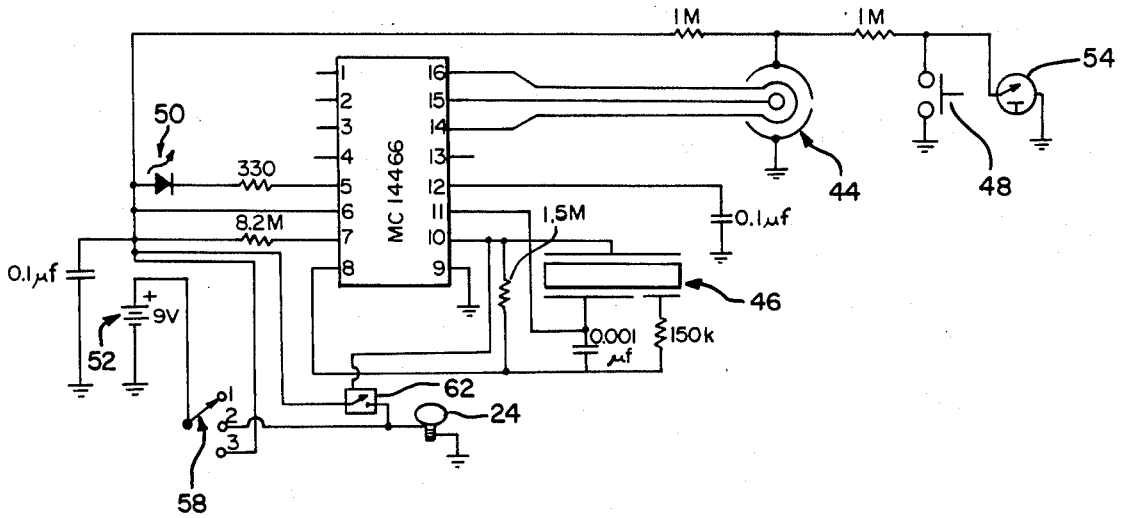
FIG. 5 is a schematic smoke detector circuit diagram in accordance with the invention.

As previously mentioned, the smoke detector may be of the ionization type and connected as shown in FIG. 5. The device includes a conventional integrated smoke detector circuit chip such as integrated circuit MC14466 produced by Motorola Semiconductor Products, Inc. The integrated circuit is connected in a conventional manner to an ionization chamber 44 so that upon detection of smoke from a fire, a piezo electric horn 46 sounds an alarm. The circuit also includes a test button 48 for testing the operation of the alarm. An optional light emitting diode 50 may be provided and periodically flashes to indicate when the apparatus is functioning properly. Also the circuit is powered by a nine-volt battery which is tested as the circuit operates. If the battery is near the end of its life, and as a result its voltage drops, the horn 46 periodically chirps, or sounds briefly, to indicate this condition.

In addition to the above described conventional circuit, the circuit of the present invention includes a temperature sensor 54 which operates upon detecting high temperatures within a room to cause the horn to sound an alarm. In addition, a three-position switch 58 is incorporated into this circuit. When in the swtich is in its first position, the entire circuit is deenergized to disable the smoke detector and prevent false alarms. As a specific example, the circuit is typically deactivated when the device is packed in a traveler's suitcase to prevent unwanted alarms. When the switch is in the second position, the battery 52 is coupled to the lamp 24. Thus, the lamp is energized and emits light. Consequently, in the event of a power outage from a fire or other emergency, the traveler can utilize the device to provide emergency lighting. Also, when the switch is in the third position, the smoke detector circuit is energized. At the same time, the battery 52 is electrically coupled through a normally open switch 62 to the lamp 24. While the switch 62 is open, the lamp remains off. However, when the horn 46 sounds, the switch 62 closes and the lamp 24 is energized and emits light. Thus, when the switch is in the third position, the smoke detector circuit is energized and the lamp is coupled to this circuit to automatically provide emergency lighting in the event a fire is detected.

The switch 58 and test button 48 are conveniently located on the face of the case 10 (FIG. 2). In addition, the switch 58 actuates a companion slide. When the switch is moved to the third position, a colored portion of the slide is positioned behind a viewing window 64 of the apparatus. This provides a visual indication that the apparatus is on.

The clock 12 comprises a conventional integrated circuit alarm clock. One suitable clock circuit is produced by the National Semiconductor Company and identified as integrated circuit MA1032 Digital LCD Clock Module.

Of course, other integrated circuit smoke detector chips and integrated circuit clock chips are equally suitable, with the substitution of one chip for another being well known to those skilled in the art.

As previously mentioned, a mechanism 38 is provided for releasably securing the case 10, and hence the smoke detector, to the upper edge of a door. In the preferred embodiment, the mechanism 38 includes an angular door gripping member 70. This door gripping member includes a horizontal arm portion 72, with an elongated slot 75, and a leg portion 74 which projects downwardly from one end of the arm portion. In addition, the mechanism 38 includes a locking element 76 with a central opening 78 which is positioned in alignment with a portion of the slot. A pin 80 with an enlarged head 82, passes through the opening 78 and slot 75. The bottom or free end 84 of the pin is square and fits within a square aperture 86 of a detachable upper section or portion 88 of the case section 14. A screw 90 fastens pin 80 to the upper case section. The detachable upper case section 88 in turn is mounted to case section 14, and thus to case 10, as explained below.

Because of the shape of lower end 84 of the pin, and the corresponding shape of opening 88, relative rotation of pin 80 and the case is prevented. In addition, the door gripping member 70 is slidable relative to the case 10, within the limits of the slot 75. Also, the locking element 76 is pivotable, upon movement of an actuating handle 92, about the axis of pin 80.

Figure 7:
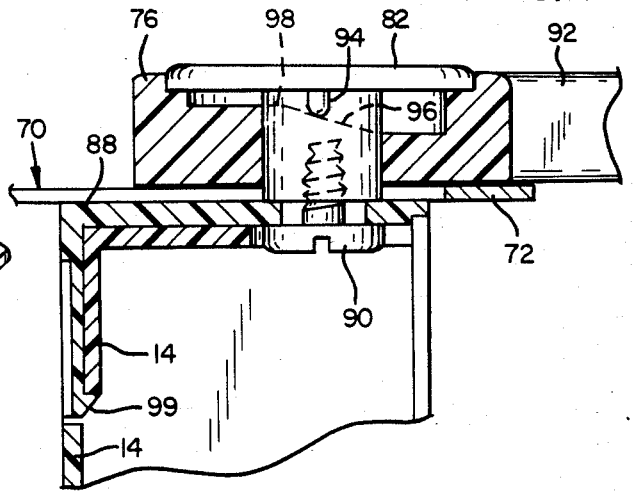
FIG. 7 is a sectional view of the door mounting mechanism of FIG. 6.

When the locking mechanism is assembled, the pin head 82 is positioned within a recess formed in the upper surface of locking element 76. In addition, cams 94 are formed in the undersurface of the pin head 82. These cams bear against camming surfaces 96 of the locking member (FIG. 7). Flats 98 intersect the upper ends of the camming surfaces.

In operation, as handle 92 is turned counterclockwise, the cams 94 travel down the camming surfaces 96 to release the door gripping member 70 so that it may be moved relative to the case 10. Conversely, turning handle 92 in a counterclockwise direction causes cams 94 to travel up the ramps 96, thereby wedging the arm portion 72 of the door gripping member between the locking member 76 and case 10. As the cams ride up the camming surface 96 and reach the flats 98, the horizontal arm portion 72, and hence the angled door gripping member 70, is locked in position.

Also, with this construction, the upper case section 88, angled door gripping member 70, locking member 76, and pin 80 may be assembled apart from the back case section 14. Thereafter, the assembled mechanism is mounted to the case section 14. Specifically, case section 14 is formed to receive the assembled mechanism with a catch 99 of the detachable upper case portion 88 engaging a portion of case section 14 to mount the assembled mechanism to the case. This facilitates manufacture of the apparatus because easy access is provided to mechanism 38 as it is assembled.

As can be seen in FIG. 2, the angled door gripping member is positionable in a first position in which the arm portion 72 abuts the top surface of the case 10 and the leg portion 74 abuts a side surface of the case. By loosening the locking member, the angled door gripping member 70 may be moved, as shown in FIGS. 3 and 4, to position the leg 74 on the opposite side of a door from the main body of the case which contains the smoke detector. The leg 74 is then slid against the door. Thereafter, the locking element is turned to lock the door gripping member 70 in position. By reversing these steps, the case can easily be removed from the door without damaging it. Thus, the smoke detector is releasably secured to the upper edge of the door and positioned near the ceiling of the room for more effective operation.

Having illustrated and described the principals of my invention with reference to one preferred embodiment, it should be apparent to those persons skilled in the art that such invention may be modified in arrangement and detail without departing from such principles.

I claim as my invention all such modifications as come within the true spirit and scope of the following claims:

1. A portable battery powered smoke detector and clock for a room comprising:

a case;

an electronic smoke detector within said case, said smoke detector including horn means for sounding an alarm upon the detection of products of combustion;

an alarm clock housing;

alarm clock means positioned within the housing;

means for detachably connecting said alarm clock means within said housing to said case such that said housing and case may be interconnected to form a compact portable unit and separated so as to permit positioning of said alarm clock means at one location within a room and said smoke detector at another location within a room;

said case including mounting means for releasably mounting the case, and thereby the smoke detector, to the upper edge of a room door to position the smoke detector at an upper elevation within the room;

said mounting means including an angular door gripping member with a horizontal arm portion having an elongate slot therein and a leg portion projecting downwardly from one end of the arm portion, and means for slidably engaging the slot for connecting the horizontal arm portion to the case such that said angled door gripping member is slidable from a compact first position in which the leg portion abuts a side surface of the case and the arm portion abuts the upper surface of the case to a second door engaging position in which the arm portion overlaps the upper edge of a room door and the leg portion is positioned at the opposite side of the door from the portion of the case containing the smoke detector; and said mounting means further comprising a locking member positioned to overlie said horizontal arm portion with an opening through the locking member aligned with a portion of said slot in said horizontal arm portion, said means for connecting the horizontal arm portion comprising a pin passing through the central opening and slot and rigidly fastened to the upper surface of the case, the free end of said pin including an enlarged head for retaining the locking member and horizontal arm portion between the head of the pin and the upper surface of the case, the undersurface of the head of the pin including a cam and the upper surface of the locking element comprising a camming surface, whereby pivoting the locking element about the axis of the pin in one direction locks the horizontal arm portion against rotation about the axis of the pin and thereby locks the angled door gripping member in position, and whereby pivoting the locking element in the other direction releases the horizontal arm portion so that the angled door grippping member is free to move between the first and second positions.

2. An apparatus according to claim 1 including means for selectively locking said angled door gripping member in position.

3. An apparatus according to claim 1 in which said locking member includes an actuating handle.

4. An apparatus according to claim 1 in which the case includes a detachable upper section, said pin being fastened to said detachable upper section, such that the pin, locking member, angled door gripping member and detachable upper section may be assembled apart from the case with the assembly thereafter being attached to the case.

* * * * *